US005806874A

United States Patent [19]

Sedlmair

[11] Patent Number: 5,806,874

[45] Date of Patent: Sep. 15, 1998

[54] DEVICE FOR CHANGING THE GROUND-PRESSURE DISTRIBUTION OF A SKI

[75] Inventor: Gerhard Sedlmair, Farchant, Germany

[73] Assignee: Marker Deutschland GmbH, Germany

[21] Appl. No.: 383,467

[22] Filed: Feb. 3, 1995

[51] Int. Cl.[6] ..... A63C 5/07

[52] U.S. Cl. ..... 280/602; 280/607

[58] Field of Search ..... 280/602, 607, 280/11.14, 636, 618, 611

[56] References Cited

U.S. PATENT DOCUMENTS

| | | | |
|---|---|---|---|
| 2,258,046 | 10/1941 | Clement | 280/602 |
| 4,674,765 | 6/1987 | Powell | 280/607 |
| 4,678,200 | 7/1987 | Powell | 280/607 |
| 5,143,395 | 9/1992 | Mayr | 280/602 |
| 5,393,086 | 2/1995 | Le Masson | 280/607 |

FOREIGN PATENT DOCUMENTS

| | | | |
|---|---|---|---|
| 299 030 | 6/1992 | Austria . | |
| 3315638 | 12/1983 | Germany | 280/602 |
| 41 00 327 A1 | 7/1991 | Germany . | |
| 43 21 239 A1 | 1/1994 | Germany . | |
| PCT/FR92/01082 | 11/1992 | WIPO . | |
| 95000217 | 1/1995 | WIPO | 280/602 |

OTHER PUBLICATIONS

English translation of DE 3315638.

*Primary Examiner*—Anne Marie Boehler
*Attorney, Agent, or Firm*—D. Peter Hochberg

[57] ABSTRACT

The central zone of a ski is stressed in the downwards direction by means of a prestressed spring arrangement. Ski zones, which are located in front of and behind said central zone, and onto which the forces exerted by the skier via the ski boot are channeled into the ski, are stressed in the upwards direction.

13 Claims, 1 Drawing Sheet

DEVICE FOR CHANGING THE GROUND-PRESSURE DISTRIBUTION OF A SKI

FIELD OF THE INVENTION

The present invention relates generally to a device for changing the vertical force or ground-pressure distribution on a ski. More specifically, the present invention relates to a device that changes the ground-pressure distribution of a ski by transmitting compressive forces, exerted by the skier onto the ski via the ski boot, in front of and behind a central zone of the ski, onto the ski.

BACKGROUND OF THE INVENTION

In the case of conventional ski bindings, the underside of the ski-boot sole is held at a more or less large spacing from the upper side of the ski. In this respect, the ski-boot sole is supported vertically by binding or supporting parts only in the toe or ball-of-the-foot region and in the heel region of the ski boot. Additional binding parts ensure that the ski-boot sole is also fixed in the sideways direction and in the upwards direction, i.e., it is fixed against being lifted from the ski.

Similar conditions are also present in the case of so-called plate bindings. In plate binding arrangements the ski boot is fixed on a separate carrying plate which is then connected to the ski. The connecting elements between plate and ski are typically located in the toe or ball-of-the-foot region and in the heel region. This arrangement is intended to ensure that bending of the ski is not hindered by the plate or the ski-boot sole. In particular, the central region of the ski can curve in the upwards direction, in the event of downwards bending of the ski ends, without butting against the underside of the carrying plate or of the ski-boot sole.

The foregoing arrangement is advantageous for the flexibility of the ski. However, the central region of the ski may exhibit only a comparatively low ground pressure during skiing. This is particularly disadvantageous if one has to ski on an icy ski slope using the ski edges transversely with respect to the slope. This can also detract from athletic swinging maneuvers.

Application No. WO 93/15797 teaches a device having a spring arranged in the central region of the ski, on the upper side of said ski. The spring forces a tread plate of a ski brake against the underside of the ski-boot sole. Accordingly, when the ski boot is fixed in the ski binding ready for commencing to ski, the tread plate of the ski brake is stressed by the above-mentioned spring, between the heel and ball-of-the-foot region, against the underside of the boot sole, i.e., the above-mentioned spring tries to lift the ski boot from the ski. The central region of the ski is forced downwards corresponding to the stressing force of the above-mentioned spring, with the result that the central region of the ski has a slightly higher ground force. However, it is critical, from a safety standpoint, to keep forcing the ski boot resiliently away from the upper side of the ski because this can impair the release behavior of the safety ski bindings.

The present invention overcomes these and other drawbacks of prior art devices.

SUMMARY OF THE INVENTION

According to the present invention, there is provided a spring arrangement arranged on the upper side of a ski. The spring arrangement prestresses downwards the central region of the ski, and prestresses upwards the supporting or ski-binding parts, or the regions of the ski beneath the supporting or skibindings parts.

According to another aspect of the present invention there is provided a spring arrangement configured as a leaf or flat spring. The leaf spring is prestressed downwards against the central region of the ski, by means of the central zone of the leaf spring and is fixed to the ski by means of upwardly prestressed zones which are spaced apart from the central zone.

According to a preferred embodiment of the present invention there is provided a spring arrangement that additionally stresses downward the regions of the ski in front of and behind the supporting or ski-binding parts, or in front of and behind upwardly prestressed regions of the ski. Accordingly, a further increased ground pressure can be achieved in front of and behind the ski boot, while at the same time the ground pressure in the region of the supporting or binding parts (which transmit the forces exerted by the skier into the ski) is adapted to the ground pressure of the adjacent regions of the ski.

The present invention is based on the general idea of channeling the forces of the spring arrangement directly into the ski or into parts fixed to the ski. Correspondingly, the spring arrangement cannot exert any forces onto the ski boot or the zones of contact between the ski boot and the supporting or ski-binding parts. The friction values at these contact zones are correspondingly left unchanged by the spring arrangement, with the result that any safety risk in terms of reproducible behavior of the safety ski bindings is also eliminated.

It is an object of the present invention to provide a device having advantageous effects on the bending behavior of the ski when skiing over bumps in the ground. In this respect, upwards bending of the ends of the ski is facilitated by the spring arrangement provided according to the invention, while reverse bending of the ends of the ski in the downwards direction tends to be made more difficult. This behavior is advantageous in principle because skiing over elevations in the ground is facilitated if the ends of the ski can bend comparatively easily in the upwards direction, while downwards bending of the ski ends is delayed.

It is another object of the present invention to provide a spring arrangement for increasing the ground pressure in the central region of the ski, and reducing the ground pressure in the region of the supporting or binding parts which transmit compressive forces, exerted by the skier onto the ski via the ski boot. The distribution of the ground pressure of the ski beneath the ski boot is thus considerably more uniform and/or is considerably better adapted to the requirements of an athletic type of skiing.

These and other objects will become apparent from the following description of preferred embodiments of the present invention, taken together with the accompanying drawings and the appended claims.

BRIEF DESCRIPTION OF THE DRAWINGS

The invention may take physical form in certain parts and arrangement of parts, preferred embodiments of which will be described in detail in the specification and illustrated in the accompanying drawings which form a part hereof and wherein.

DETAILED DESCRIPTION OF THE PREFERRED EMBODIMENT

Figure 1:
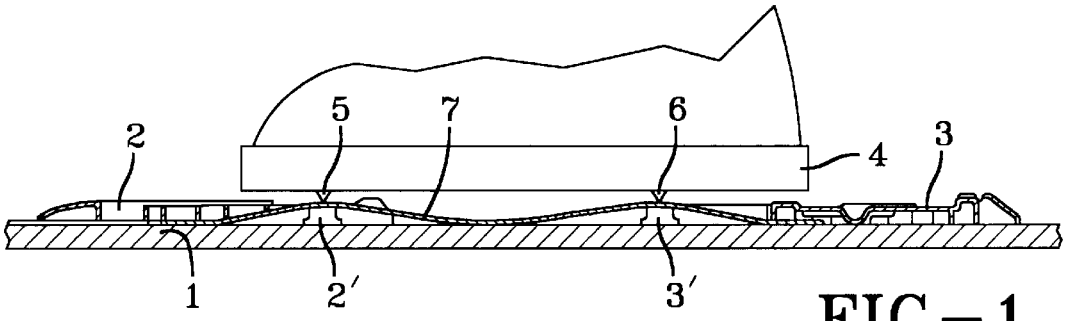
FIG. 1 is a sectional side view of the present invention according to a preferred embodiment.

Referring now to the drawings wherein the showing is for the purpose of illustrating a preferred embodiment of the invention only, and not for the purpose of limiting same, FIG. 1 shows a front spacer plate 2 and a rear spacer plate 3, mounted on the upper side of a ski 1, such that they are fixed to the ski. It will be appreciated that front and rear ski binding parts can be mounted together with spacer plates 2 and 3, respectively. Accordingly, the ski binding parts are held at a relatively large spacing from the upper side of the ski by spacer plates 2 and 3. Thus, the skier is "elevated" on the ski, as desired particularly by top skiers.

Figure 3:
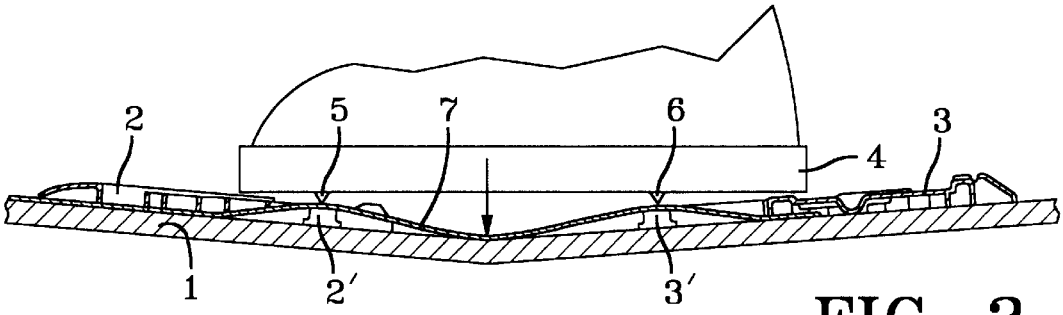
FIG. 3 is a side sectional view of the device shown in FIG. 1, where the ski is bent with upwards of the ski ends.

Ski binding parts are configured such that forces exerted by a sole 4 of a ski boot in the vertical downwards direction are transmitted onto ski 1 only at front supporting zone 5 and rear supporting zone 6. Supporting zones 5 and 6 are shown in FIGS. 1 and 3 by arrow tips. It should be understood that the arrow tips do not represent any structure. Accordingly, ski boot sole 4 rests only on the portions of leaf spring 7 at supporting zones 5 and 6. Leaf spring 7 is described in detail below. In the region of supporting zones 5 and 6, spacer plates 2 and 3 have, respectively, front and rear stable brackets 2' and 3', which bear fixedly on the upper side of the ski or are fastened to the ski. It should be appreciated that stable brackets 2' and 3' may be separate from spacer plates 2 and 3.

Figure 2:
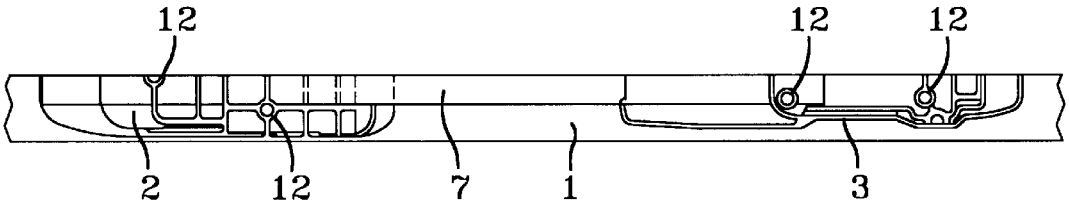
FIG. 2 is a sectional top plan view of the device shown in FIG. 1.

A flat or leaf spring 7 is arranged between spacer plates 2 and 3. Leaf spring 7 is comprised of a highly elastic material such as a spring metal (e.g., Titanal). The convex side of leaf spring 7 is directed downwards. By means of its convex central zone, leaf spring 7 bears under prestressing on the upper side of the central region of ski 1. Those portions of leaf spring 7 which are directed forwards and rearwards of the central zone, in the longitudinal direction of the ski, are fixedly secured in the region of brackets 2' and 3' at a distance from the upper side of the ski, for example, by the ski binding parts (not shown), stressed by means of fastening screws. Bores 12 in plates 2 and 3 (see FIG. 2) receive the fastening screws. In addition, bores formed in the region of brackets 2' and 3' may also receive the fastening screws.

The above-mentioned fastening screws may also pass through corresponding bores formed in leaf spring 7 in the region of spacer plates 2 and 3, and in the region of brackets 2' and 3', For instance, fastening screws may pass through bores in leaf spring 7 in the region of one spacer plate (e.g., spacer plate 3), in order to fix leaf spring 7 in a positively locking manner in the longitudinal direction of ski 1. In contrast, in the region of the other spacer plate (e.g., spacer plate 2), leaf spring 7 may be secured such that it can be displaced in the longitudinal direction of ski 1 between the front ski-binding part and spacer plate 2, to provide a so-called sliding fit. It will be appreciated that leaf spring 7 may be fixed at brackets 2' and 3', while the ends thereof are arranged to move freely in the region of spacer plates 2 and 3. Alternatively, leaf spring 7 may merely rest on brackets 2' and 3', while the ends thereof are fixed in the region of spacer plates 2 and 3.

Leaf spring 7 tries to force the central region of ski 1 in the downwards direction, and force the regions of ski 1 in the area of brackets 2' and 3', in the upwards direction. Accordingly, the ground pressure of ski 1 is increased in the central region of ski 1, and reduced at the region of ski 1 in the area of brackets 2' and 3', where the vertical forces exerted by the skier onto ski 1 via the ski boot are transmitted onto ski 1. In this manner, it is possible to achieve in the entire region between brackets 2' and 3', a uniform ground pressure or a ground-pressure distribution in which the ground pressure is at a maximum in the central region of ski 1.

According to a preferred embodiment of the present invention, leaf spring 7 has ends which project beyond brackets 2' and 3', and are, respectively, stressed elastically against the upper side of ski 1. Accordingly, the ground pressure of the regions of ski 1 at the above-mentioned ends of leaf spring 7 are also increased. The ends of leaf spring 7, which project beyond brackets 2' and 3', bear displaceably on the upper side of ski 1 in the longitudinal direction of ski 1. Alternatively, the above-mentioned ends of leaf spring 7 may be secured such that they are fixed to ski 1 in the longitudinal direction of ski 1.

Figure 4:
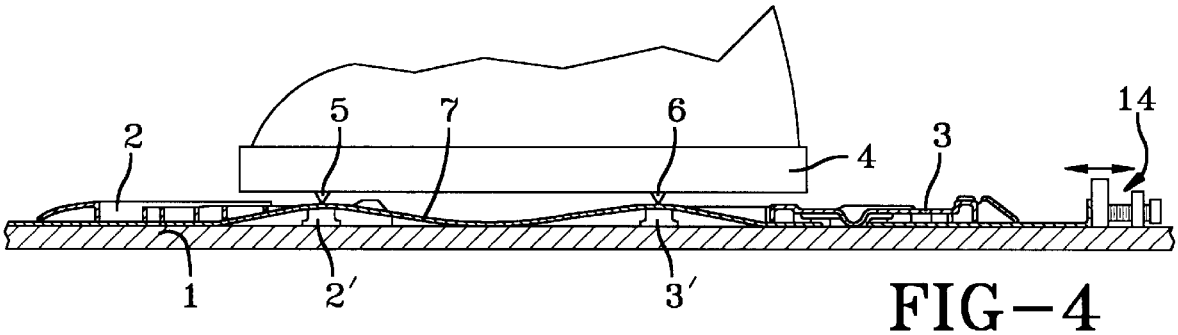
FIG. 4 sectional side view of the present invention according to another preferred embodiment having an adjustable stop.

It will also be appreciated that the displaceability of the above-mentioned ends of leaf spring 7 in the forwards direction may be restricted, in the case of the front end of leaf spring 7. Similarly, the displaceability of the ends of leaf spring 7 in the rearwards direction may be restricted in the case of the rear end of leaf spring 7. In this respect, adjustable stops may be arranged on ski 1 or, preferably, on spacer plates 2 and 3. FIG. 4 illustrates a preferred embodiment of the present invention, wherein the end of leaf spring 7 in the rearwards direction extends beyond the rear end of rear spacer plate 3. The longitudinal displaceability of the end of spring 7 is restricted by an adjustable stop 14 arranged on ski 1.

If the ends of leaf spring 7 are arranged such that they can be displaced freely in the longitudinal direction of the ski, then upon bending of ski 1 as shown in FIG. 3, leaf spring 7 forces the bent central region of ski 1 in the downwards direction with a comparatively low degree of force.

In contrast, if the above-mentioned ends of leaf spring 7 are secured, in front of bracket 2' and behind bracket 3', such that the ends of leaf spring 7 are fixed to the ski or have a narrowly restricted displaceability, then leaf spring 7, in the case of the bending of ski 1 represented in FIG. 3, is also subjected, to a pronounced extent, to shearing forces in the longitudinal direction of the ski. Accordingly, the central zone of leaf spring 7 forces the central region of ski 1 downwards with a comparatively large degree of force. A similar effect is achieved when leaf spring 7 is secured at or near brackets 2' and 3', such that leaf spring 7 cannot be displaced in the longitudinal direction of the ski.

In each case, it is thus achieved that, when skiing through depressions in the ground, the central region of the ski also has a comparatively high ground pressure.

In addition, or as an alternative to the adjustable stops which may be present at the ends of leaf spring 7, the stressing of leaf spring 7 may also be changed by securing leaf spring 7 such that it is vertically adjustable in the region of brackets 2' and 3'. Moreover, it will be appreciated that leaf spring 7 may be exchanged for a different leaf spring having different prestressing. Accordingly, different requirements of the skier can be met (e.g., different weight of the skier, a different style of skiing, or the like).

The above-described arrangements give rise to the general concept of channeling the forces exerted by the skier onto ski 1, in particular the weight of the skier, at least partially into the center of ski 1. In the preferred embodiments described above, this "channeling" occurs by means of leaf spring 7 or another type of spring arrangement which distributes the forces arising at supporting points 5 and 6, partially into the center region of the ski.

It should be appreciated that the foregoing embodiments are described for the purposes of illustration only and that numerous alterations and modifications may be practiced by those skilled in the art without departing from the spirit and scope of the invention. It is intended that all such modifications and alterations be included insofar as they come within the scope of the invention as claimed or equivalents thereof.

The invention claimed is:

1. A device for changing the ground-pressure distribution of a ski, said device comprising:

a ski;

support means arranged on the ski for supporting a ski boot on the ski, and transmitting compressive forces exerted by a skier onto a front ski zone in front of a central ski zone and at a rear ski zone behind the central ski zone; and spring means arranged on the upper side of the ski, for prestressing downwards the central ski zone, and prestressing upwards the front ski zone and the rear ski zone, and prestressing downwards a region of the ski in front of the front ski zone and a region of the ski behind the rear ski zone, at least one end of said spring means displaceable with respect to the longitudinal direction of the ski.

2. A device for changing the ground-pressure distribution of a ski as defined in claim 1, wherein said spring means is a leaf spring having a central spring zone, a front spring zone and a rear spring zone on opposite sides of the central spring zone, said central spring zone prestressed downwards against said central zone of the ski, and prestressed upwards at the front and rear spring zones, the front and rear spring zones being fixed relative to the ski.

3. A device for changing the ground-pressure distribution of a ski as defined in claim 2, wherein said device further comprises securing means which are fixable to the ski, said leaf spring spaced apart from the upper side of the ski at the region of said securing means when said securing means is fixed to the ski.

4. A device for changing the ground-pressure distribution of a ski as defined in claim 2, wherein said leaf spring forces upwards the region of the ski beneath the heel and the region of the ski beneath the forward part of the boot.

5. A device for changing the ground-pressure distribution of a ski as defined in claim 2, wherein said leaf spring is comprised of opposing ends extending in the longitudinal direction of the ski beyond the front and rear ski zones, said opposing ends of the leaf spring prestressed downward against the upper side of the ski.

6. A device for changing the ground-pressure distribution of a ski as defined in claim 2, wherein said one of said opposing ends of said leaf spring is fixed in the longitudinal direction.

7. A device for changing the ground-pressure distribution of a ski as defined in claim 6, wherein said opposing ends of said leaf spring have some degree of freedom in the longitudinal direction of the ski.

8. A device for changing the ground-pressure distribution of a ski as defined in claim 6, wherein said opposing ends of said leaf spring exert a downward force on the ski, beneath the front end and rear end of the ski-boot sole.

9. A device for changing the ground-pressure distribution of a ski as defined in claim 1, wherein the prestressing of said support means is changeable.

10. A device for changing the ground-pressure distribution of a ski as defined in claim 1, wherein said spring means is replaceable with a second spring means having a different spring characteristic than said spring means.

11. A device for changing the ground-pressure distribution of a ski as defined in claim 1, wherein said spring means at least partially channels the weight of the skier into the central zone of the ski.

12. A device for changing the ground-pressure distribution of a ski as defined in claim 1, said device further comprising at least one stop means for impeding movement of the spring means in the longitudinal direction of the ski.

13. A device for changing the ground-pressure distribution of a ski as defined in claim 1, said device further comprising;

a front spacer plate means arrangeable in the region of the ski in front of the front ski zone; and a rear spacer plate means arrangeable in the region of the ski behind the rear ski zone.

* * * * *

UNITED STATES PATENT AND TRADEMARK OFFICE

CERTIFICATE OF CORRECTION

PATENT NO. : 5,806,874
DATED : September 15, 1998
INVENTOR(S) : Gerhard Sedlmair It is certified that error appears in the above-identified patent and that said Letters Patent is hereby corrected as shown below:

Title page.
Add the following: -- Foreign Priority Data: German Ser. No. P 44 03 151.3 filed Feb. 3, 1994 --.

Signed and Sealed this

Nineteenth Day of March, 2002

*Attest:*

*Attesting Officer*

JAMES E. ROGAN
*Director of the United States Patent and Trademark Office*